US006621231B1

(12) United States Patent
Kwon

(10) Patent No.: US 6,621,231 B1
(45) Date of Patent: Sep. 16, 2003

(54) STRUCTURE OF A BARRIER IN A PLASMA DISPLAY PANEL

(75) Inventor: Hyuk Chae Kwon, Daegu-si (KR)

(73) Assignee: Orion Electric Co., Ltd., Kyungsangbuk-Do (KR)

( * ) Notice: Subject to any disclaimer, the term of this patent is extended or adjusted under 35 U.S.C. 154(b) by 0 days.

(21) Appl. No.: 10/148,281

(22) PCT Filed: Nov. 21, 2000

(86) PCT No.: PCT/KR00/01340

§ 371 (c)(1),
(2), (4) Date: May 28, 2002

(87) PCT Pub. No.: WO01/41178

PCT Pub. Date: Jun. 7, 2001

(30) Foreign Application Priority Data

Nov. 30, 1999 (KR) ..... 99-54075

(51) Int. Cl.[7] ..... H01J 9/24; H05B 41/00
(52) U.S. Cl. ..... 315/169.3; 445/24
(58) Field of Search ..... 315/169.3, 169.4, 315/169.1; 313/485, 585, 495, 582; 445/24; 430/198

(56) References Cited

U.S. PATENT DOCUMENTS 5,906,527 A * 5/1999 Shaikh et al. ..... 445/24
5,985,460 A * 11/1999 Wang et al. ..... 428/426
6,411,035 B1 * 6/2002 Marcotte ..... 313/585
2002/0195936 A1 * 12/2002 Kato et al. ..... 313/582

* cited by examiner

*Primary Examiner*—Don Wong
*Assistant Examiner*—Chuc D Tran
(74) *Attorney, Agent, or Firm*—Notaro & Michalos P.C.

(57) ABSTRACT

A structure of barrier ribs in the plasma display panel is provided. The structure of barrier ribs in a plasma display panel is characterized by comprising at least one barrier rib of a half-matrix shape 35 to 37 and 45 to 48 in which protrusions 38, 39 and 49 are formed between the barrier ribs, thereby being capable of complementing the different emission characteristics among the three kinds (R, G, and B) of phosphors to be used in the plasma display panel with improving the whole luminescence and a white balance, simplifying processes of manufacturing it, and enhancing working steadiness and the reliability of the post process.

15 Claims, 5 Drawing Sheets

STRUCTURE OF A BARRIER IN A PLASMA DISPLAY PANEL

TECHNICAL FIELD

The present invention relates generally to a plasma display panel, and more particularly, to the structure of barrier ribs in the plasma display panel which can improve the whole luminescence and a white balance, simplify processes of manufacturing it, and enhance working steadiness and the reliability of the post process by complementing the different emission characteristics among three Kinds(R, G, and B) of phosphors to be used in the plasma display panel.

BACKGROUND ART

FIG. 1 illustrates a schematic partial sectional view of a conventional plasma display panel. As shown in FIG. 1, the plasma display panel comprises a first substrate 11 and a second substrate 21 faced parallel to each other, and barrier ribs 25 formed to maintain the constant distance between the first substrate 11 and the second substrate 21 and to define a discharge space 30. Discharge gas such as Xe, Ne, He, etc., is filled in the discharge space 30. A plurality of first substrate electrodes are arranged in a spaced and parallel relationship to each other on the surface of the first substrate 11 which opposes to the second substrate 21, said first substrate electrodes being formed of complex electrodes 12, 14, 13 and 15 which consist of transparent electrodes 12, 13 and metal electrodes 14 and 15. A dielectric layer 17 and a MgO protective layer 18 are formed thereon in order. Said discharge space 30 defines a plurality of discharge cells and black stripes 16 can also be formed between the adjoining discharge cells.

A plurality of address electrodes 22 are arranged in a spaced and parallel relationship to each other on the surface of the second substrate 21 so as to define a plurality of discharge cells 10 at cross-points of the first substrate electrodes or the complex electrodes 12, 14 and 13, 15. A dielectric layer 27 is formed so as to cover the address electrodes 22, and a phosphor layer 24 is formed so as to cover the side walls of the barrier ribs 25 exposed to the discharging space 30 and the bottom surface of the discharging space 30.

Also, an underlayer 23 may be formed between the address electrodes 22 and the second substrate 21 in order to prevent from being diffused and migrated into adjoining functional layers such as the electrodes, etc., and to enhance the printing characteristics of the functional layers.

By applying predetermined voltages between the complex electrodes 12, 14, 13 and 15 from an alternating current source and forming an electric field in such an alternating current plasma display panel, discharge is performed within each of the discharge cells 10 as a display element, which is separated to each other by the first substrate 11, the second substrate 21 and the barrier ribs 25. And, by ultraviolet rays which are generated during such discharge, the phosphor layer 24 emits visible light which penetrates the first substrate 11 and makes images. Also, the underlayer 23 and the dielectric layer 27 are formed on the second substrate 21 as shown in the illustrative example, but may not be formed if not necessary.

The transparent electrodes 12 and 13 of the first substrate 11 are formed by coating with ITO or $SnO_2$ and then patterning with the photo-etching technology, then the metal electrodes 14 and 15 are formed with Cr/Cu/Cr, Cr/Al/Cr, etc. The other structures such as the dielectric layer 17, the black stripes 16, the barrier ribs 25, etc., are formed with the print technology such as a screen print technology, an offset print technology, etc., the sand blasting, the squeezing technology, the photo-etching technology, etc.

SUMMARY OF THE INVENTION

However, there is one problem in a dynamic margin since, among the phosphors generally used for the phosphor layer 24 in the plasma display panel, $(Y,Gd)BO_3$:Eu of R phosphor and $BaMgAl_{10}O_{17}$:Eu of B phosphor have plus(+) charge characteristics, but $Zn_2SiO_4$:Mn of G phosphor has minus(−) charge characteristics, thereby making the discharge voltage higher.

There is also, another problem in that it is very difficult to control a white balance since the characteristics of the phosphors used in the phosphor layer 24 are different from each other as described above.

Meanwhile, in a structure of barrier ribs as illustrated in FIGS. 2*a* and 2*b*, the barrier ribs are arranged in a stripe shape and the manufacturing process is simple, but it is a problem that visible light generated by the discharges is leaked out in the stripe direction of the barrier ribs.

Furthermore, in a matrix-structure of barrier rib as illustrated in FIGS. 3*a* and 3*b*, it is possible to define each color cell, thereby improving the luminance, to block the leakage of light and to prevent crosstalk in all directions, but its manufacturing is very difficult due to the troublesome process.

Accordingly, in order to the above discussed problems, the present invention provides structures of barrier ribs in the plasma display panel which can improve the whole luminescence and a white balance, simplify processes of manufacturing it, and enhance working stability and the reliability of the post process by complementing the different emission characteristics among three kinds of phosphors (R, G, and B) to be used in the plasma display panel.

To achieve the above-mentioned object, in accordance with one embodiment of the present invention, there is provided a structure of barrier rib in a plasma display panel wherein images are displayed by emitting visible light from three kinds of phosphor(R, G, and B) layers between a plurality of barrier ribs using the discharge phenomenon caused by applying each pulse for scanning and displaying to a plurality of electrodes in order, said structure of barrier ribs being characterized by comprising at least one barrier rib of a half-matrix shape in which protrusions are formed between the barrier ribs.

Said structure of barrier rib further may comprise at least one connection portion to connect the barrier ribs, thereby comprising a matrix-shaped barrier rib in a portion. And, the protrusions in the opposite sides of the half-matrix-shaped barrier rib may be different in width, and/or the half-matrix-shaped barrier rib may be constituted in an arrangement such that widths of the protrusions in the same direction of the half-matrix-shaped barrier rib increase or decrease according to an arrangement of the three Kinds of phosphor(R, G, and B) layers.

Moreover, the half-matrix-shaped barrier rib and widths of the protrusions may be constituted different from each other based on a kind of the phosphor in the phosphor layers, and/or in a relationship with a position on a screen in the plasma display panel.

DETAILED DESCRIPTION OF THE PREFERRED EMBODIMENTS

Now, preferred embodiments of the present invention will be described in detail with reference to the accompanying drawings hereinafter.

Figure 1:
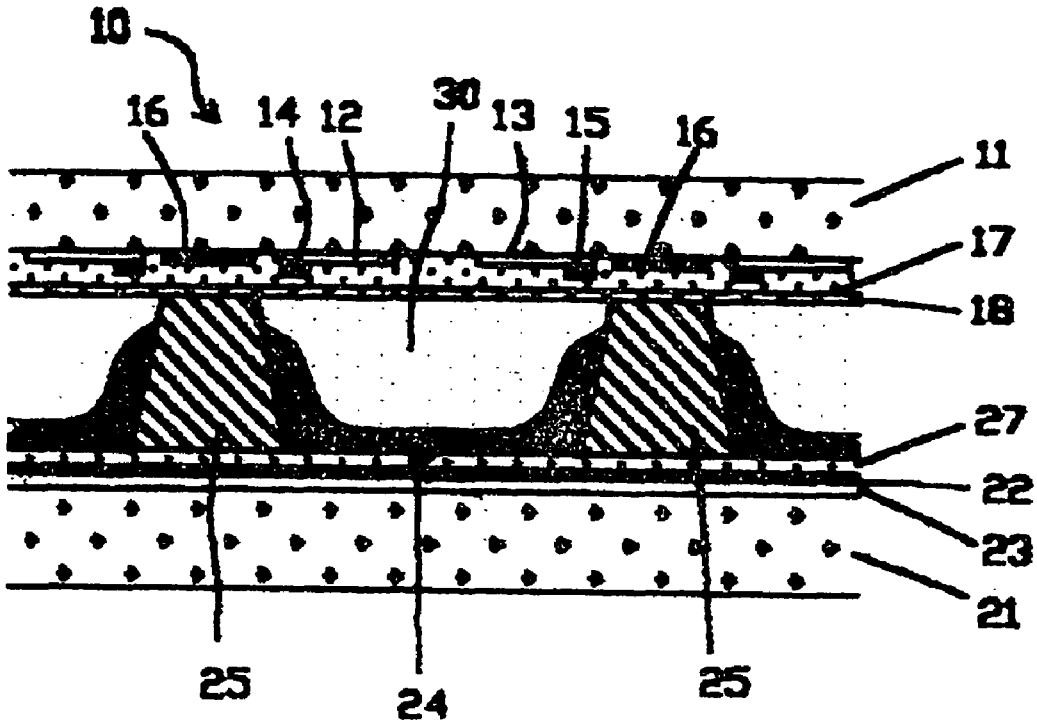
FIG. 1 (PRIOR ART)
FIG. 1 is a partially sectional schematic view of a conventional plasma display panel.
Figure 2A:
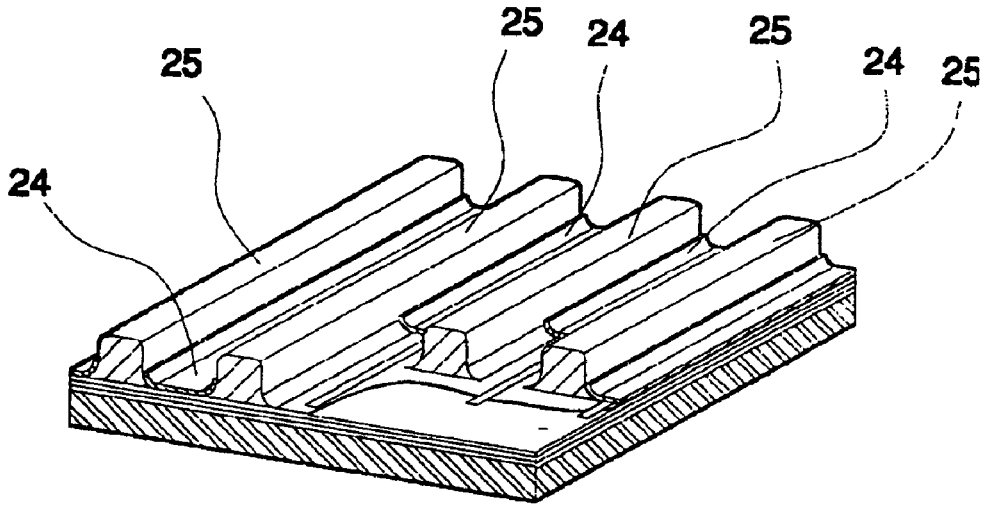
FIG. 2a (PRIOR ART)
FIG. 2*a* is a partial perspective view schematically illustrating a conventional structure of stripe-shaped barrier ribs.
Figure 2B:
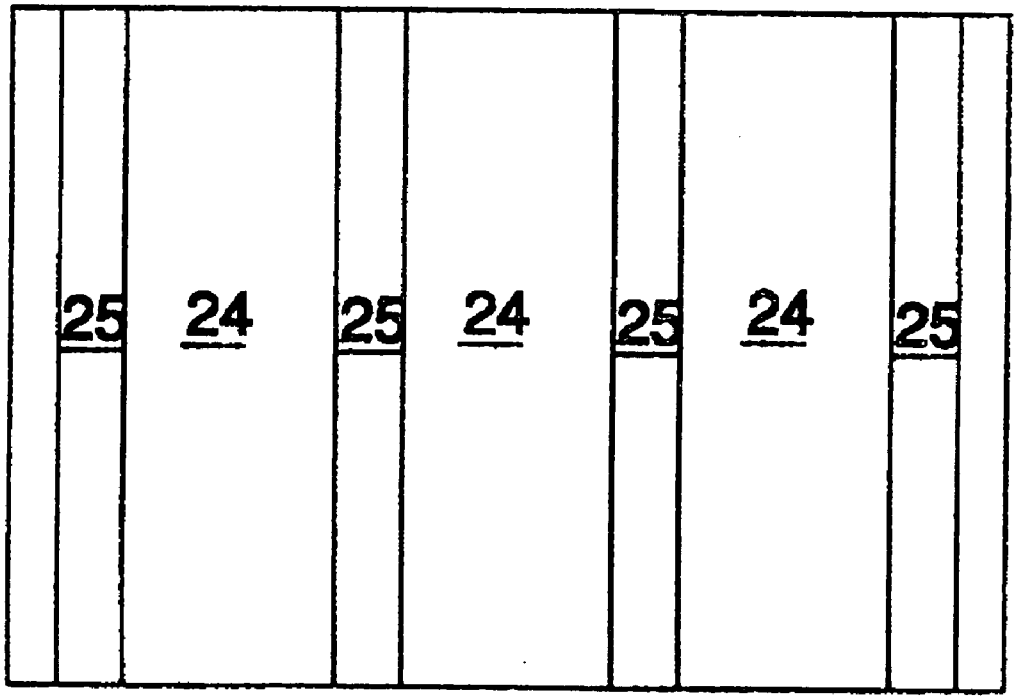
FIG. 2b (PRIOR ART)
FIG. 2*b* is a plan view of FIG. 2*a*.
Figure 3A:
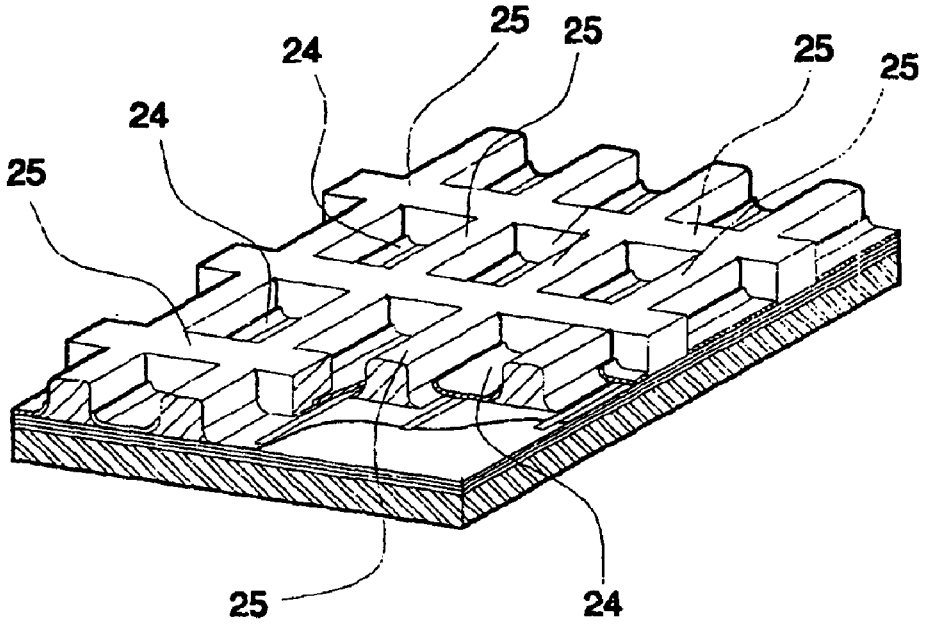
FIG. 3a (PRIOR ART)
FIG. 3*a* is a partial perspective view schematically illustrating a conventional structure of matrix-shaped barrier ribs.
Figure 3B:
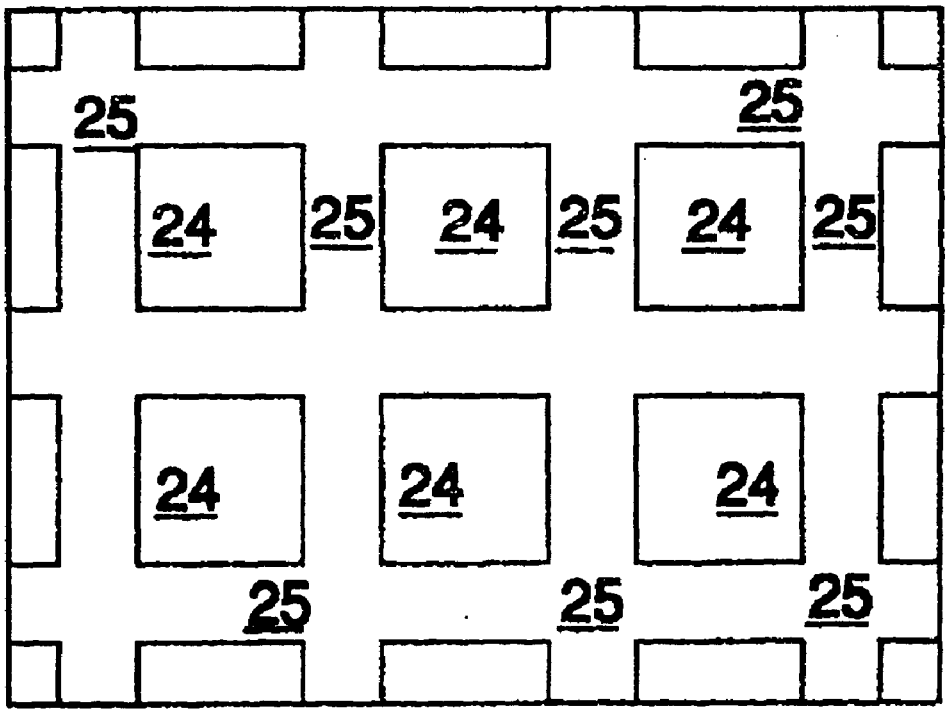
FIG. 3b (PRIOR ART)
FIG. 3*b* is a plan view of FIG. 3*a*.

A color plasma display panel to which the present invention is embodied, as generally illustrated in FIG. 1, includes two sheet-like front and back glass substrates having.elements such as electrodes, barrier ribs, dielectric layers, phosphor layers, etc., disposed on the opposite inner surfaces thereof. The two substrates are hermetically sealed by a seal at the periphery of the panel with an inner impure gas evacuated and a discharge gas filled therebetween. Thus, the phosphor particles are excited by an ultraviolet ray which is generated during discharge between the electrodes, thereby emitting visible light of a particular color depending on a kind of the phosphors in the color plasma display panel.

The barrier ribs among the elements have a function providing a gap between the two second substrates for a discharge space 30 and providing an application space for the phosphor s .

In FIGS. 4*a* to 5*b*, a structure of barrier ribs in a plasma display panel according to embodiments of the present invention is schematically illustrated as a partial perspective view and a plan view, As shown in FIGS. 4*a* to 5*b*, the basic structure of barrier ribs according to the present invention comprises at least one barrier rib of a half-matrix shape 35 to 37 and 45 to 48 in which protrusions 38, 39 and 49 are formed between the barrier ribs.

Figure 4A:
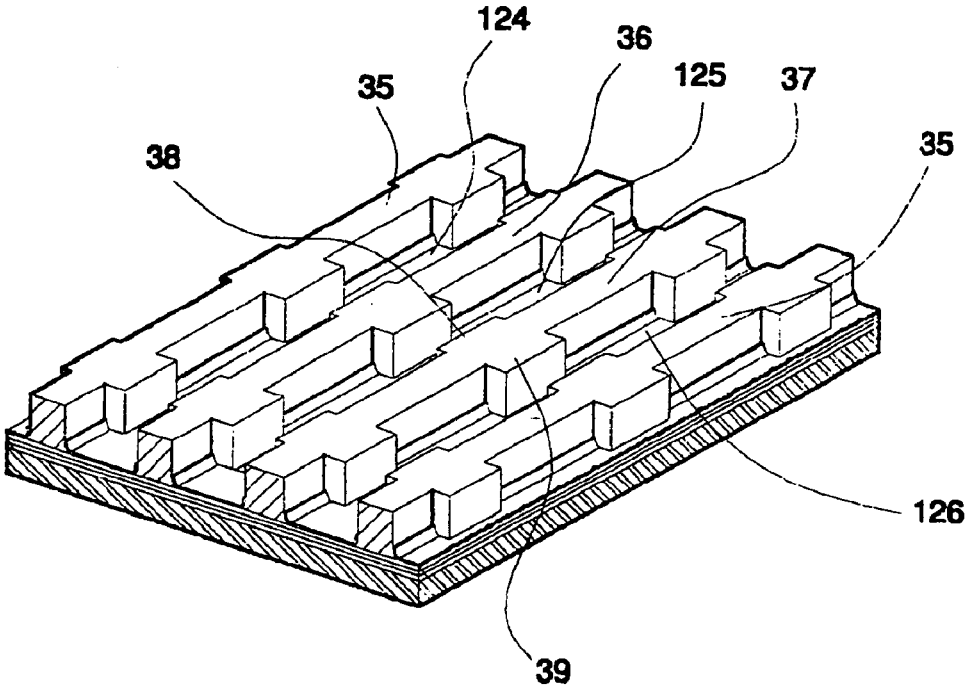
FIGS. 4*a* and 4*b* are a partial perspective view and a plan view, schematically illustrating a structure of half-matrix-shaped barrier rib according to one embodiment of the present invention.
Figure 4B:
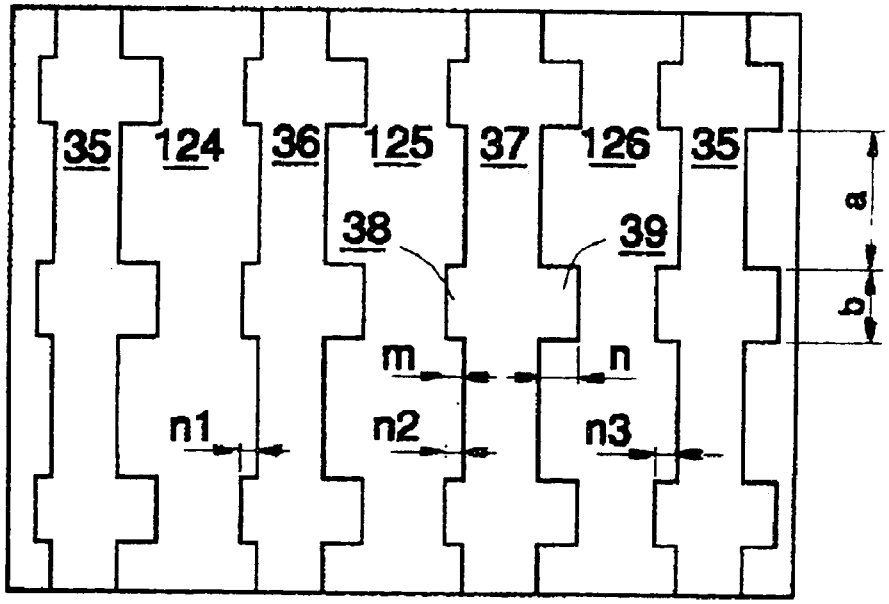
Figure 5A:
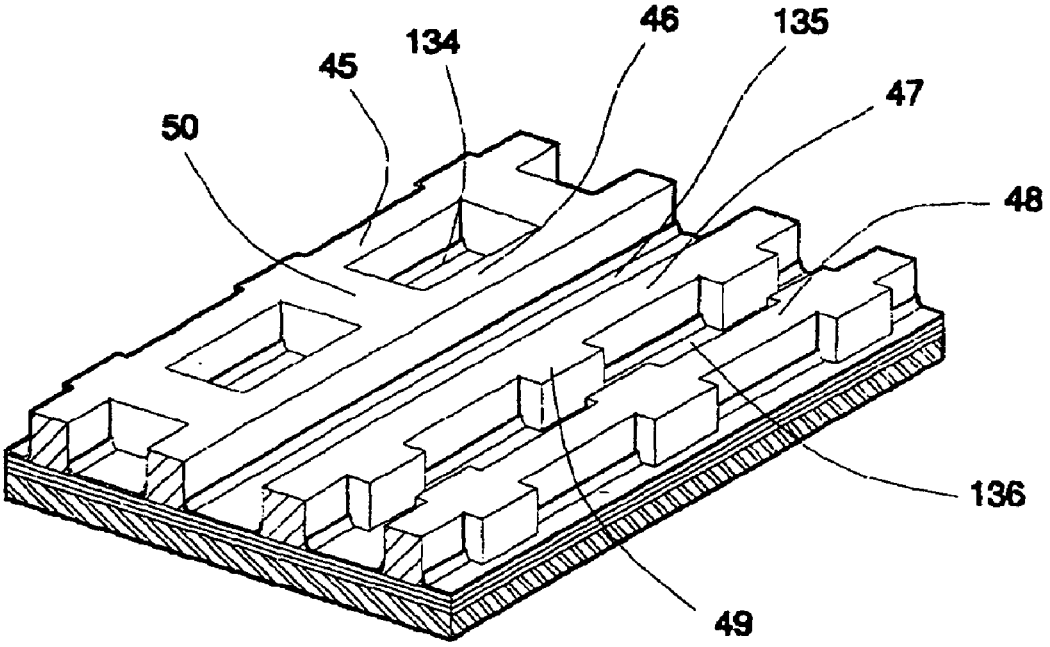
FIGS. 5*a* and 5*b* are a partial perspective view and a plan view, schematically illustrating a structure of barrier rib which comprises both whole-matrix-shaped barrier ribs and half-matrix-shaped barrier ribs according to another embodiment of the present invention.
Figure 5B:
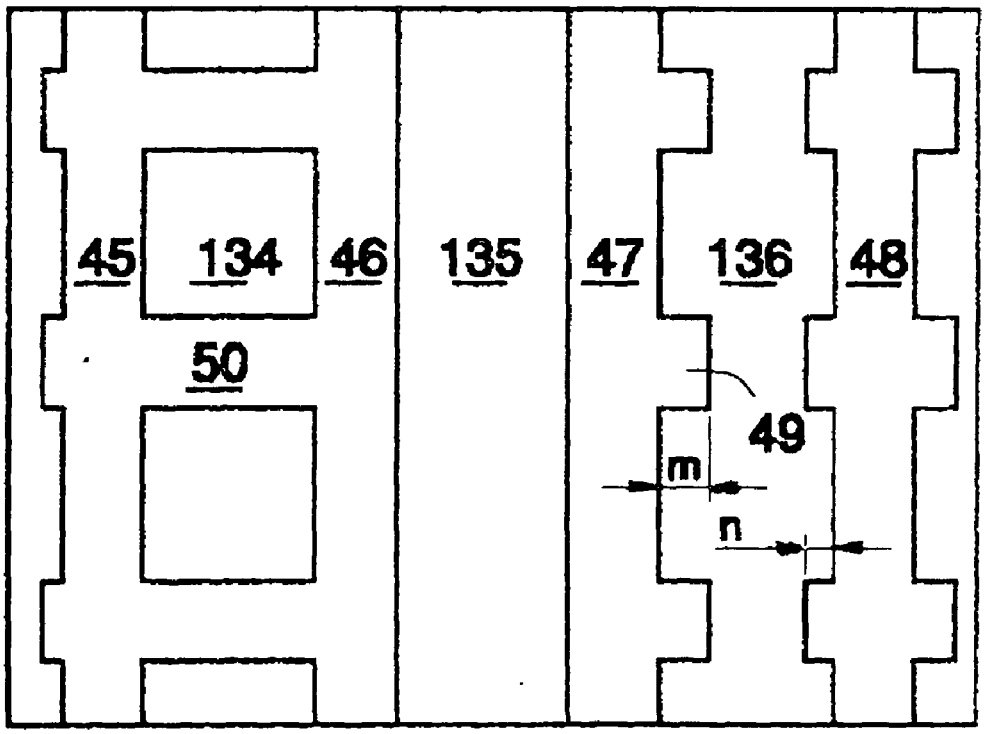

That is, the barrier ribs are all consisted of half-matrix-shaped barrier ribs 35, 36 and 37 as shown in FIGS. 4*a* and 4*b*. Also, as shown in FIGS. 5*a* and 5*b*, the structure of the barrier ribs comprises a pure half-matrix-shaped barrier rib 48, a mixed half-matrix-shaped barrier rib 45 which has connection portions 50 to connect the barrier ribs at one side and a protrusions at the other side, a mixed half-matrix-shaped barrier rib 46 which has connection portions 50 to connect the barrier ribs at one side and is formed of stripe shape at the other side, and a half-matrix-shaped barrier rib 47 which is formed of stripe shape at one side and has protrusions at the other side.

In such half-matrix-shaped barrier ribs 35 to 37, and 45 to 48, the widths m and n of the protrusions 38, 39 and 49 may be same or different between each other at the opposite sides of the half-matrix-shaped barrier ribs. And also the widths of the protrusions in the same sides of the half-matrix-shaped barrier rib may increase or decrease according to an arrangement of the three kinds of phosphor(R, G, and B) layers 24.

That is, half-matrix-shaped barrier ribs may be formed for one or two kinds of the phosphors among a first to a third phosphor layers 124 to 126 and 134 to 136, and the half-matrix-shaped barrier ribs may be constituted in a manner that the widths m and n of the protrusions 38, 39 and 49 are different.

In FIG. 4*b*, the half-matrix-shaped barrier ribs 36, 37 and 35 may be formed such that the widths n1, n2 and n3 of the protrusions 38 in the same sides or the left sides of the half-matrix-shaped barrier ribs 36, 37 and 35 increase or decrease according to an arrangement of the three kinds of phosphor(R, G, and B) layers 24.

In addition, barrier ribs, as not shown in the drawings, may be arranged in combination with various half-matrix-shaped barrier ribs and a whole-matrix-shaped barrier rib in a relationship with a position such as a central position or a peripheral position on a screen in the plasma display panel. Also, widths of the protrusions may be different from each other in a relationship with a position on a screen in the plasma display panel.

For examples of different arrangements for each of R, G, and B phosphor layers, barrier ribs for R phosphor layers ("135" in FIG. 5b) are formed of a stripe-shape at the opposite sides thereof. Barrier ribs for G phosphor layers ("136" in FIG. 5*b*) are formed of an half matrix shade at the opposite sides thereof, and barrier ribs for B phosphor layers("134" in FIG. 5*b*) are formed of a whole-matrix-shape at the opposite sides thereof. Also, whole-matrix-shaped barrier ribs may be formed for any one or two phosphor layers among the R, G, and B phosphor layers and half-matrix-shaped barrier ribs for others. A various combination among stripe-shaped barrier ribs, half-matrix-shaped barrier ribs and whole-matrix-shaped barrier ribs may be applied according to the characteristics of phosphors, and/or according to the structures and the driving characteristics of plasma, display panels.

Further, a length b of the protrusions 38 and 39 of the half-matrix-shaped barrier ribs 35 to 37, as shown in FIGS. 4*a* and 4*b*, is preferably shorter than a length a of the distance between the protrusions 38 and 39.

By providing such half-matrix-shaped barrier ribs 35 to 37 and 45 to 48 according to the present invention, it is advantageous that an application area or a surface area of the phosphors can be easily controlled, and conduct or guiding of evacuation during an assembly process can be improved. And, by means of the half-matrix-shaped barrier ribs, discharge gas can be easily filled between the substrates with Keeping its equilibrium over the whole space between the substrates, and charged particles can be easily moved between the cells. Further, the coating characteristics of the phosphor layers and the formation quality of the barrier ribs become improved. Besides, the present invention has much more advantages.

Such half-matrix-shaped barrier ribs 35 to 37 and 45 to 48 in accordance with the present invention can be applied to all plasma display panels including an alternating current or direct current type plasma display panel, a transmissive or reflective type plasma display panel and a confrontation discharge or surface discharge type plasma display panel, etc.

By the above-described construction and acting of the structure of barrier ribs in the plasma display panel in accordance with preferred embodiments of the present invention, the different emission characteristics among the three kinds(R, G, and B) of phosphors can be complemented, thus the whole luminescence and a white balance can be improved, and working steadiness and the reliability of the post process can be enhanced.

Additional advantages and modifications will readily occur to those skilled in the art. Therefore, the invention in its broader aspects is not limited to the specific details and representative embodiments shown and described herein. Accordingly, various modifications can be made without departing from the spirit or scope of the general inventive concept as defined by the appended claims and their equivalent.

What is claimed is:

1. A structure of barrier ribs in a plasma display panel wherein images are displayed by emitting visible light from three kinds of phosphor(R, G, and B) layers between a plurality of barrier ribs using the discharge phenomenon caused by applying each pulse for scanning and displaying to a plurality of electrodes in order, said structure of barrier ribs being characterized by comprising at least one barrier rib of a half-matrix shape in which protrusions are formed between the barrier ribs.

2. The structure of barrier ribs in a plasma display panel according to claim 1, wherein said structure of barrier ribs further comprises at least one connection portion to connect the barrier ribs.

3. The structure of barrier ribs in a plasma display panel according to claim 1, wherein the protrusions in the opposite sides of the half-matrix-shaped barrier rib are different in width.

4. The structure of barrier ribs in a plasma display panel according to claim 1, wherein the half-matrix-shaped barrier rib is constituted in an arrangement such that widths of the protrusions in the same direction of the half-matrix-shaped barrier rib increase or decrease according to an arrangement of the three kinds of phosphor(R, G, and B) layers.

5. The structure of barrier ribs in a plasma display panel according to claim 1, wherein the half-matrix-shaped barrier rib and widths of the protrusions are constituted different from each other based on a kind of the phosphor in the phosphor layers.

6. The structure of barrier ribs in a plasma display panel according to claim 1, wherein the half-matrix-shaped barrier rib and widths of the protrusions are constituted different from each other in a relationship with a position on a screen in the plasma display panel.

7. A structure of barrier ribs in a plasma display panel wherein images are displayed by emitting visible light from three kinds of phosphor(R, G, and B) layers between a plurality of barrier ribs using the discharge phenomenon caused by applying each pulse for scanning and displaying to a plurality of electrodes in order, said structure of barrier ribs being characterized by comprising at least one barrier rib of a half-matrix shape in which protrusions are formed between the barrier ribs and the protrusions in the opposite sides of the half-matrix-shaped barrier rib are different in width.

8. The structure of barrier ribs in a plasma display panel according to claim 7, wherein the half-matrix-shaped barrier rib is constituted in an arrangement such that widths of the protrusions in the same direction of the half-matrix-shaped barrier rib increase or decrease according to an arrangement of the three kinds of phosphor(R, G, and B) layers.

9. The structure of barrier ribs in a plasma display panel according to claim 7, wherein the half-matrix-shaped barrier rib and widths of the protrusions are constituted different from each other based on a kind of the phosphor in the phosphor layers.

10. The structure of barrier ribs in a plasma display panel according to claim 7, wherein the half-matrix-shaped barrier rib and widths of the protrusions are constituted different from each other in a relationship with a position on a screen in the plasma display panel.

11. A structure of barrier ribs in a plasma display panel wherein images are displayed by emitting visible light from three kinds of phosphor(R, G, and B) layers between a plurality of barrier ribs using the discharge phenomenon caused by applying each pulse for scanning and displaying to a plurality of electrodes in order, said structure of barrier ribs being characterized by comprising a plurality of barrier ribs of a half-matrix shape in which protrusions are formed between the barrier ribs, the half-matrix-shaped barrier ribs being constituted in an arrangement such that widths of the protrusions in the same direction of the half-matrix-shaped barrier rib increase or decrease according to an arrangement of the three kinds of phosphor(R, G, and B) layers.

12. The structure of barrier ribs in a plasma display panel according to claim 11, wherein the half-matrix-shaped barrier rib and widths of the protrusions are constituted different from each other based on a kind of the phosphor in the phosphor layers.

13. The structure of barrier ribs in a plasma display panel according to claim 11, wherein the half-matrix-shaped barrier rib and widths of the protrusions are constituted different from each other in a relationship with a position on a screen in the plasma display panel.

14. A structure of barrier ribs in a plasma display panel wherein images are displayed by emitting visible light from three kinds of phosphor(R, G, and B) layers between a plurality of barrier ribs using the discharge phenomenon caused by applying each pulse for scanning and displaying to a plurality of electrodes in order, said structure of barrier ribs being characterized by comprising a plurality of barrier ribs of a half-matrix shape in which protrusions are formed between the barrier ribs, the half-matrix-shaped barrier rib and widths of the protrusions being constituted different from each other based on a kind of the phosphor in the phosphor layers.

15. The structure of barrier ribs in a plasma display panel according to claim 14, wherein the half-matrix-shaped barrier rib and widths of the protrusions are constituted different from each other in a relationship with a position on a screen in the plasma display panel.

* * * * *